United States Patent [19]

Roberts

[11] Patent Number: 4,600,975

[45] Date of Patent: Jul. 15, 1986

[54] ARCHITECTURAL LIGHTING APPARATUS

[76] Inventor: James R. Roberts, 4501 N. Western, Oklahoma City, Okla. 73118

[21] Appl. No.: 573,639

[22] Filed: Jan. 25, 1984

[51] Int. Cl.[4] ..... F21S 1/14

[52] U.S. Cl. ..... 362/147; 362/223; 362/306; 362/225; 362/310; 362/240; 362/311; 362/249; 362/374; 362/368; 362/375

[58] Field of Search ..... 362/145, 147, 240, 223, 362/225, 310, 306, 368, 151, 249, 311, 374, 375

[56] References Cited

U.S. PATENT DOCUMENTS

| | | | |
|---|---|---|---|
| 2,569,518 | 10/1951 | Deutsch et al. | 362/151 |
| 2,569,934 | 10/1951 | Kurtzon | 362/151 X |
| 3,271,568 | 9/1966 | Lundberg | 362/151 X |
| 3,478,667 | 11/1969 | Bourquin | 362/147 X |
| 3,831,020 | 8/1974 | Paulson | 362/145 X |
| 4,298,916 | 11/1981 | Shemitz | 362/223 X |
| 4,338,653 | 7/1982 | Marrero | 362/147 X |
| 4,394,718 | 7/1983 | Balzer | 362/306 X |
| 4,415,957 | 11/1983 | Schwartz | 362/147 X |

FOREIGN PATENT DOCUMENTS

| | | | |
|---|---|---|---|
| 606874 | 10/1960 | Canada | 362/147 |

*Primary Examiner*—Peter A. Nelson

*Attorney, Agent, or Firm*—Robert M. Hessin

[57] ABSTRACT

An indirect lighting assembly consisting of a housing structure and low voltage light tubing for retention therein, said housing structure being a unitarily extruded body having an anchor tab portion extending perpendicularly into a spacer portion and terminating in a light tube housing portion having an open area directing light generally perpendicular to the plane of said spacer portion.

12 Claims, 4 Drawing Figures

ARCHITECTURAL LIGHTING APPARATUS

BACKGROUND OF THE INVENTION

1. Field of the Invention

The invention relates generally to decorative lighting apparatus and, more particularly, but not by way of limitation, it relates to improved lighting apparatus that is particularly adaptable for many indoor and outdoor indirect lighting applications.

2. Description of the Prior Art

The prior art includes a number of different types of illuminating source and reflective structures which are utilized to provide either directed or diffused light for diverse purposes and functions. Some of the more recent developments utilize the recently developed low voltage light tubes which provide longer lifetime, and lesser illumination but more uniform light saturation. Many such light tubes are utilized in various configurations for decorative illumination purposes while still other applications are directed to various approaches for indirect illumination. In particular, U.S. Pat. No. 4,143,411 utilizes low voltage light tubing for indirect lighting of spaces. This patent particularly teaches the use of a specific mold extrusion which defines a light tube retaining structure that has bifurcated flanges and cavity structure for use in specific indirect lighting installations. Still other prior art techniques teach the use of light tubing in various direct and indirect lighting applications simply by bonding or clamping the tubing structure directly to an overhand or underlying decorative structure.

SUMMARY OF THE INVENTION

The present invention relates to improvements in indirect lighting structure of the type utilizing low voltage light tubing or the like. More particularly, the invention is directed to a particular form of retaining member for receiving light tubing while providing a relatively universal spacing and mode of securing for a large number of indirect lighting applications. The securing flange or anchor tab is adapted for all modes of indirect lighting application and for use with various types of ceiling, cove and base molding.

Therefore, it is an object of the present invention to provide an indirect lighting assembly having versatile application.

It is also an object of the present invention to provide lighting apparatus for indoor indirect lighting applications that is relatively low cost yet extremely reliable in operation.

It is still further an object of the present invention to provide lighting apparatus which assures even, uniform illumination of indirect reflective space.

Finally, it is an object of the present invention to provide indirect lighting apparatus which may be utilized with many different forms of commercially available molding and interior decorative structure.

Other objects and advantages of the invention will be evident from the following detailed description when read in conjunction with the accompanying drawings which illustrate the invention.

DETAILED DESCRIPTION OF THE INVENTION

Figure 1:
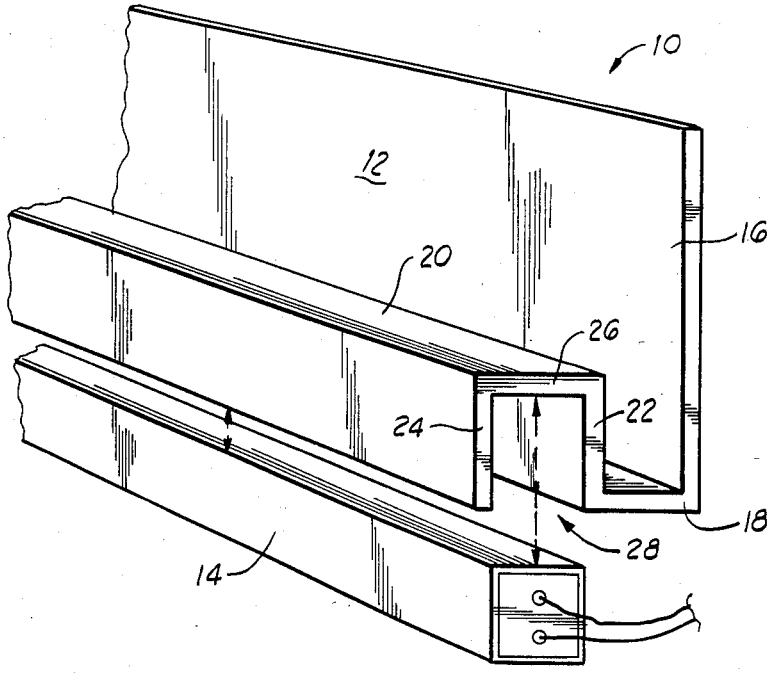
FIG. 1 is a perspective view of a portion of lighting apparatus as constructed in accordance with the present invention.

FIG. 1 illustrates the indirect lighting structure 10 of the present invention as it consists of a housing extrusion 12 with a light source 14 received therein. The housing extrusion 12 is preferably a unitary, extruded plastic member which provides the functions of providing an anchor tab, providing a spacing element to assure illumination spacing from a support structure, and also providing a partially reflective, opaque receptacle for retaining the light source hidden from direct view. Thus, the housing extrusion 12 may be extruded from such as polyvinyl chloride (PVC), Acrylonitrile Butadiene Styrene (ABS), or other suitable extrusion resins. The extrusion is shaped to provide an anchor tab 16 which extends at right angles into a spacer portion 18 that is further formed with right angle bend to form a light housing 20 consisting of opposite sides 22 and 24 and backpanel 26.

The dimensions of housing 20 are selected for ready reception of coacting light sources 14. Thus, an interior volume or receptacle 28 of generally square cross-section is sized to tightly receive a square, tubular light source 14 closely therein. The source 14 may be secured as by double-edge taping, epoxy or the like to maintain the source upward within receptacle 28. A number of commercially available light sources 14 may be utilized, but a preferred form is a light tube that is commercially available from Roberts Step-Lite Systems, Inc. of Oklahoma City, Okla. This tubing is available in clear or colored tubing as formed from rigid lucite, or flexible lexan.

The light tubing may be procured as tubes as small as three-eights inch in width and the tubes may be operated on either a 12 volt or 24 volt power supply. Thus, light tubing is available having from six to twelve individual bulbs per foot thereby to provide total output of from five to ten foot candles. The light tubing 14 is coactively secured within receptacle 28 of housing structure 10 to prevent direct viewing as the anchor tab 16 is retained by moldings or other decorative structure. The spacer portion 18 is selected to separate anchor tab 16 and receptacle 28 by a distance sufficient to eliminate or greatly lessen "hot" spots that may show up along the adjacent wall when the light tubing is disposed too close. The term "hot" spots actually describes uneven brightness and glare problems since heat generation is not a problem with the light sources utilized herein.

Figure 2:
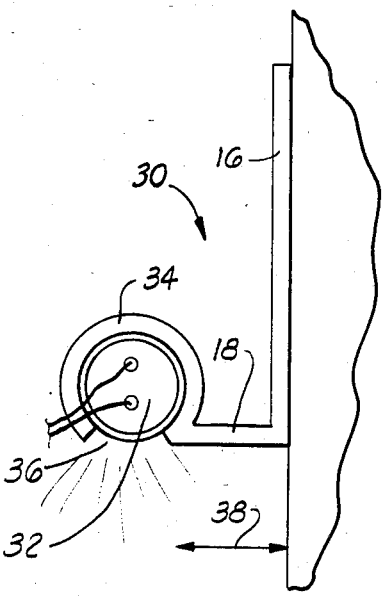
FIG. 2 is an end view in elevation of the lighting apparatus of FIG. 1.

FIG. 2 shows an end view of an indirect lighting extrusion 30 that is adapted to retain a round type of tubular low-voltage light source 32 for indirect lighting affixure. Thus, extrusion 30 consists of an anchor tab 16 formed into the spacer portion 18 and thereaftr terminated in a round light housing portion 34 having open portion 36 for allowing directive light radiation. Such round light tubing 32 is also commercially available from such as Roberts Step-Lite Systems, Inc. of Oklahoma City, Okla. in diametric sizes commensurate with snap-in or bonded affixure within the resilient round light housing 34 of indirect lighting structure 30. The spacer portion 18, on the order of one-half inch or thereabouts, provides freedom from "hot" spots along the length of the illumination structure.

Figure 3:
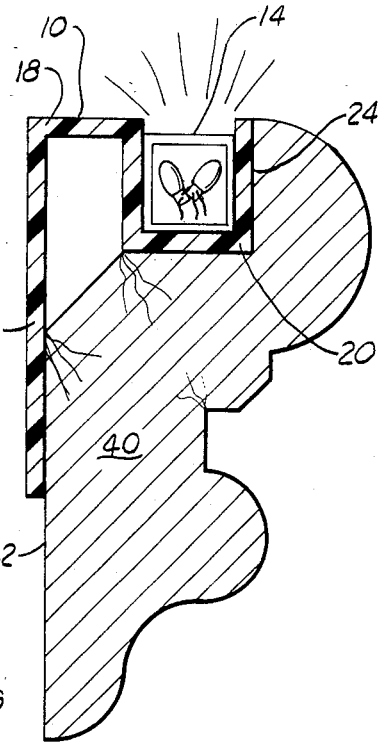
FIG. 3 is a view in section showing the lighting apparatus in combination with a cove or ceiling-type molding.

FIG. 3 illustrates one form of indirect lighting design used as an indirect lighting structure 10 is employed in combination with ceiling molding 40 of stock, commercial shape. Thus, the anchor tab 16 is disposed along the upper portion of wall structure with spacer portion 18 parallel to and sufficiently below the associated ceiling to allow a selected area of indirectly lighted wall area thereabove, and the stock form of ceiling molding 40 is then secured thereover. Thus, a side 42 of molding 40 secured to the adjoining wall also secures anchor tab 16 while the upper extremities of molding 40 fit coactively with the light source retaining housing 20. It should be understood that the ceiling molding 40 represents but one of a great many of stock varieties and the indirect lighting structure 10 is designed for use with and adaptation to all such types of molding. In some applications, the exterior housing side 24 will be visible in installation and the structure 10 is formed of material which readily receives paint or other decorative finishing material.

Figure 4:
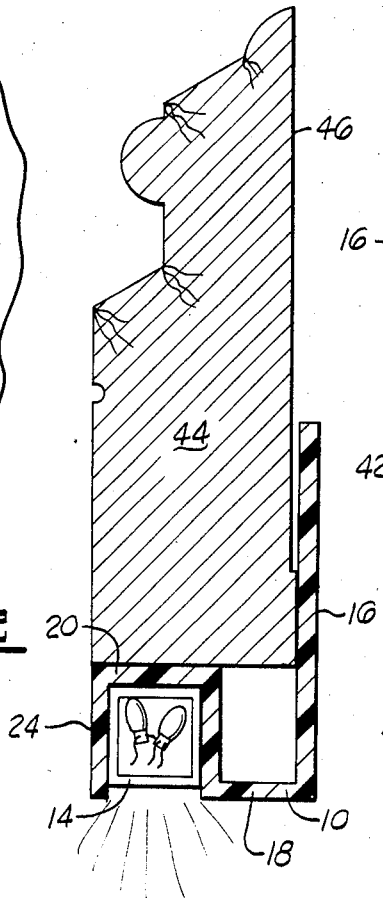
FIG. 4 is a view in section showing the lighting apparatus of the present invention as installed with a standard form of baseboard molding.

FIG. 4 illustrates the indirect lighting structure 10 as it is employed in combination with a baseboard molding 44 to provide lower extremity indirect lighting as desired. The baseboard molding 44 is also a standard, commercially available type and it should be understood that the structure 10 can be utilized in combination with a very large number of standard form baseboard moldings. Here again, the baseboard molding 44 may be bonded or fastened to the adjoining wall structure at surface 46 while also securing anchor tab 16 therebelow. The baseboard molding 44 and structure 10 would be disposed with spacer portion 18 at a sufficient distance above the floor, e.g. four inches or other heights depending upon carpet color and thickness, and other design criteria, and spacer portion 18 still serves to eliminate uneven brightness variations along the reflecting exposed wall portion. In an application such as that of FIG. 4, the outer wall portion 24 of retainer 20 may be painted or stained in accordance with room decor thereby essentially to remain invisible.

The foregoing discloses novel light retaining structure for indirect lighting utilizing continuous length low voltage light sources. The indirect lighting extrusion member is adapted for versatile application with any of various standard forms of molding or other decor configurations as it provides an anchoring portion, a spacer portion of size compatible with such low voltage illumination sources, and a source retaining structure for retaining the illumination source in indirect lighting configuration. Thus, the single, uniform extrusion structure varied only as to the shape of retaining structure can be utilized in any of a great number of interior or exterior decorating schemes as it is easily combinable with all attendant structures and the final painting or finishing materials.

Changes may be made in the combination and arrangement of elements as heretofore set forth in the specification and shown in the drawings, it being understood, that changes may be made in the embodiments disclosed without departing from the spirit and scope of the invention as defined in the following claims.

What is claimed is:

1. An indirect lighting fixture comprising:

an elongated tubular light source having uniform cross-section;

a unitarily formed light housing structure having an anchor tab portion for flat affixure to associated planar structure, a spacer portion extending generally perpendicularly from one edge of said anchor tab portion, and a uniform elongated housing portion extending from said spacer portion distal from said anchor tab portion and receiving said light source securely therein, said housing portion defining an elongated volume open at generally one-quarter of the circumphery with said open portion directed perpendicular to said spacer portion.

2. A fixture as set forth in claim 2 wherein:

said housing portion defines a volume having square cross-section.

3. A fixture as set forth in claim 1 wherein:

said housing portion defines a volume having round cross-section.

4. A fixture as set forth in claim 1 wherein said light source comprises:

uniform elongated tubing formed of transparent thermoplastic tubing; and a string of low-voltage responsive lamps having a selected number of lamps per unit length disposed through said elongated tubing.

5. A fixture as set forth in claim 4 wherein:

said housing portion defines a volume having square cross-section.

6. A fixture as set forth in claim 4 wherein:

said housing portion defines a volume having round cross-section.

7. A fixture as set forth in claim 1 wherein said light housing structure comprises:

an extrusion of unitarily formed, light reflective thermoplastic material.

8. An indirect lighting mounting structure for receiving elongate, low-voltage light tubing, comprising:

a unitarily formed structure having an anchor tab portion for flat affixure to associated planar structure, a spacer portion extending generally perpendicularly from one edge of said anchor tab portion, and a uniform elongated housing portion extending from said spacer portion distal from said anchor tab portion for receiving said light tubing securely therein, said housing portion defining an elongated volume open at approximately one-quarter of the circumphery with said open portion directed perpendicular to said spacer portion.

9. A fixture as set forth in claim 8 wherein:

said housing portion defines a volume having square cross-section.

10. A fixture as set forth in claim 8 wherein:

said housing porion defines a volume having round cross-section.

11. An elongate indirect lighting mounting structure comprising:

a unitarily formed, partially reflective elongate opaque housing structure having an extrusion of unitarily formed, light reflective thermoplastic material, an anchor tab portion for flat affixure to associated types of ceiling, cove and base molding and a spacer portion extending generally perpendicularly from one edge of said anchor tab portion a distance sufficient to eliminate uneven brightness and glare;

a uniform elongated housing portion distal from said anchor tab portion for receiving said light tubing securely therein, said housing portion defining an elongated volume having square cross-section open at approximately one-quarter of the circumphery with said open portion directed perpendicular to said spacer portion; and an elongated low voltage tubular light source formed of transparent thermoplastic tubing, having uniform cross-section, having a string of low voltage responsive lamps with a selected number of lamps per unit length disposed through said elongated tubing, said tubing being coactively secured within said housing structure to prevent direct viewing.

12. A fixture as set forth in claim 11 wherein:

said housing portion defines a volume having round cross-section.

* * * * *